US008299669B2

(12) United States Patent
Gieras et al.

(10) Patent No.: US 8,299,669 B2
(45) Date of Patent: Oct. 30, 2012

(54) RIM DRIVEN THRUSTER HAVING TRANSVERSE FLUX MOTOR

(75) Inventors: Jacek F. Gieras, Glastonbury, CT (US); Gregory I. Rozman, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 270 days.

(21) Appl. No.: 12/906,825

(22) Filed: Oct. 18, 2010

(65) Prior Publication Data

US 2012/0093669 A1 Apr. 19, 2012

(51) Int. Cl.
*H02K 5/10* (2006.01)

(52) U.S. Cl. ..... 310/87; 310/156.02

(58) Field of Classification Search ..... 310/87, 310/156.02, 156.12, 254.1
See application file for complete search history.

(56) References Cited

U.S. PATENT DOCUMENTS

| | | | | |
|---|---|---|---|---|
| 1,759,511 | A | 5/1930 | Kort | |
| 2,139,594 | A | 12/1938 | Kort | |
| 3,708,251 | A * | 1/1973 | Pierro | 417/356 |
| 4,367,413 | A * | 1/1983 | Nair | 290/52 |
| 4,459,087 | A * | 7/1984 | Barge | 417/356 |
| 4,831,297 | A | 5/1989 | Taylor et al. | |
| 5,078,628 | A * | 1/1992 | Garis, Jr. | 440/6 |
| 5,185,545 | A * | 2/1993 | Veronesi et al. | 310/114 |
| 5,220,231 | A * | 6/1993 | Veronesi et al. | 310/90 |
| 5,306,183 | A | 4/1994 | Holt et al. | |
| 5,607,329 | A | 3/1997 | Cho et al. | |
| 5,702,273 | A | 12/1997 | Cho et al. | |
| 6,527,522 | B2 | 3/2003 | Chen | |
| 6,670,737 | B2 | 12/2003 | Chen | |
| 6,713,899 | B1 | 3/2004 | Greubel et al. | |
| 6,837,757 | B2 | 1/2005 | Van Dine et al. | |
| 6,952,068 | B2 | 10/2005 | Gieras et al. | |
| 7,124,495 | B2 | 10/2006 | Gieras et al. | |
| 7,443,065 | B2 | 10/2008 | Chen et al. | |
| 2007/0145751 | A1 * | 6/2007 | Roos | 290/52 |
| 2008/0211326 | A1 | 9/2008 | Kang et al. | |
| 2010/0052467 | A1 | 3/2010 | Gieras | |
| 2012/0156070 | A1 * | 6/2012 | Tanaka et al. | 417/423.7 |
| 2012/0201703 | A1 * | 8/2012 | Tanaka et al. | 417/423.7 |

FOREIGN PATENT DOCUMENTS

| | | | |
|---|---|---|---|
| EP | 1 840 025 | A2 | 10/2007 |
| EP | 2 159 903 | A2 | 3/2009 |
| EP | 2 239 194 | A1 | 10/2010 |
| EP | 2 330 723 | A1 | 6/2011 |

(Continued)

OTHER PUBLICATIONS

Extended European Search Report from International Application No. EP11189763.3, dated Apr. 26, 2012.

(Continued)

*Primary Examiner* — Thanh Lam
(74) *Attorney, Agent, or Firm* — Kinney & Lange, P.A.

(57) ABSTRACT

A rim driven thruster comprises an annular housing, a propulsor assembly, a magnetic rotor assembly and a transverse flux stator assembly. The annular housing defines a flow path extending along an axis. The propulsor assembly is supported within the housing and comprises propeller blades extending radially from the axis of the flow path. The propeller blades are configured to rotate about the axis. The magnetic rotor assembly is mounted to radially outer ends of the propeller blades. The transverse flux stator assembly is mounted to the annular housing and is configured to provide electromagnetic torque to the magnetic rotor assembly.

21 Claims, 7 Drawing Sheets

FOREIGN PATENT DOCUMENTS

WO WO 2007/084004 A1 7/2007

OTHER PUBLICATIONS

G. Kastinger, "Design of a Novel Transverse Flux Machine", Jul. 29, 2004, from <http://web.archive.org/web/20040729060046/http://www.ansoft.com/news/articles/Design_of_Tansverse_Flux_Machine.pdf, 6 pages.

G. Henneberger et al., "On the Parameters Computation of a Single Sided Transverse Flux Motor", from Workshop on Electrical Machines' Parameters, Technical University of Cluj-Napoca, pp. 35-40 (May 26, 2001).

"Y.S. Tech TMD Fan", from Dan's Data—PC Hardware and Gadgets Independently Reviewed, http://dansdata.com/tmdfan.html, 2 pages (Reviewed May 2002, Updated Apr. 2008, visited Aug. 31, 2010).

Y.G. Guo et al., "Study of Permanent Magnet Transverse Flux Motors with Soft Magnetic Composite Core", from Australasian Universities Power Engineering Conference, 6 pages (Sep. 26-29, 2004).

"Brunvoll Presents a 'Rim Driven Thruster' (RDT)", pp. 1-6 (Jun. 9, 2005).

S. H. Lai, "Design Optimisation of a Slotless Brushless Permanent Magnet DC Motor with Helically-Wound Laminations for Underwater Rim-Driven Thrusters", Thesis for the Degree of Doctor of Philosophy—University of Southhampton, 169 pages (Mar. 2006).

J.F. Gieras, "Status of Linear Motors in the United States", from United Technologies Research Center, International Symposium for Linear Drives for Industry Apjplications—LDIA'2004, Manchester U.K., 8 pages (2004).

Dr. Adel Gastli, "Electromechanical Systems & Actuators—Linear Motors", pp. 2-37 (2006).

O. Krovel et al., "Design of an Integrated 100k W Permanent Magnet Synchronous Machine in a Prototype Thruster for Ship Propulsion", 6 pages (2004).

J. F. Gieras, "Permanent Magnet Motor Technology, Design and Applications 3rd Edition" pp. 364-401 (Aug. 26, 2009).

S. H. Lai et al, "Structurally Integrated Slotless PM Brushless Motor with Spiral Wound Laminations for Marine Thrusters", 5 pages (Mar. 12, 2007).

S. Nichols et al., "Integrated Motor, Propulsor (IMP) and Drive Electronics for High Power Density Propulsion", from Electrical Machines Technology Symposium EMTS2006, US Navy, Philadelphia, PA, 9 pages (2006).

O. Krovel et al., "Thermal Properties of a Prototype Permanent Magnetized Electrical Motor Embedded in a Rim Driven Thurster", 6 pages (May 5, 2006).

N. Parspur et al., "Transverse Flux Machine Design for Manipulating System Applications", 5 pages (2004).

BALDOR Catalog, "Linear Motors and Stages" 48 pages (Aug. 2007).

* cited by examiner

RIM DRIVEN THRUSTER HAVING TRANSVERSE FLUX MOTOR

BACKGROUND

The present invention is directed generally to rim driven thrusters (RDT) used as propulsion systems for watercraft and the like. More particularly, the present invention relates to permanent magnet brushless motors for RDTs.

In rim driven thrusters, an electro-magnetic motor is integrated with propeller blade propulsors. In typical RDTs, a rotor assembly is integrated at outer diameter ends of the propeller blades and a stator assembly is integrated into a stationary annular housing surrounding the propeller blades. The stator assembly electro-magnetically causes the rotor assembly to rotate and generate propulsive thrust with the propeller blades. The housing is connected to the vessel through a pylon that rotates about a vertical axis so that the RDT is able to provide propulsion and steering in a single unit.

RDTs are advantageous for submerged operation because the electro-magnetic motor is removed from the center of the propulsor. In such a configuration, electrically active components of the stator assembly are positioned within the housing so as to be easily insulated. Moreover, the motor is positioned so as to minimize hydraulic drag. Specifically, the stator assembly is positioned within the annular housing and the rotor assembly is positioned in close proximity to the housing at the outer diameter of the blades. The stator and rotor assemblies are, however, still exposed to hydraulic drag when submerged. Thus, it becomes desirable to reduce the thickness of the rotor and stator assemblies to further minimize hydrodynamic losses.

Typical RDTs utilize conventional slotted stator cores in the stator assembly. In these designs, however, it is difficult to accommodate multiple windings in the narrow and shallow slots that are needed to achieve favorable thickness dimensions. Another proposal for reducing stator core thickness has included the use of a slot-less stator winding and spiral wound stator core laminations. This stator assembly design is expensive, difficult to manufacture and suitable only for small motors. There is, therefore, a need for a permanent magnet motor configuration having favorable hydraulic drag properties in an easily and inexpensively manufactured configuration.

SUMMARY

The present invention is directed to a rim driven thruster having a transverse flux motor. The rim driven thruster comprises an annular housing, a propulsor assembly, a magnetic rotor assembly and a transverse flux stator assembly. The annular housing defines a flow path extending along an axis. The propulsor assembly is supported within the housing and comprises propeller blades extending radially from the axis of the flow path. The propeller blades are configured to rotate about the axis. The magnetic rotor assembly is mounted to radially outer ends of the propeller blades. The transverse flux stator assembly is mounted to the annular housing and is configured to provide electromagnetic torque to the magnetic rotor assembly.

DETAILED DESCRIPTION

Figure 1:
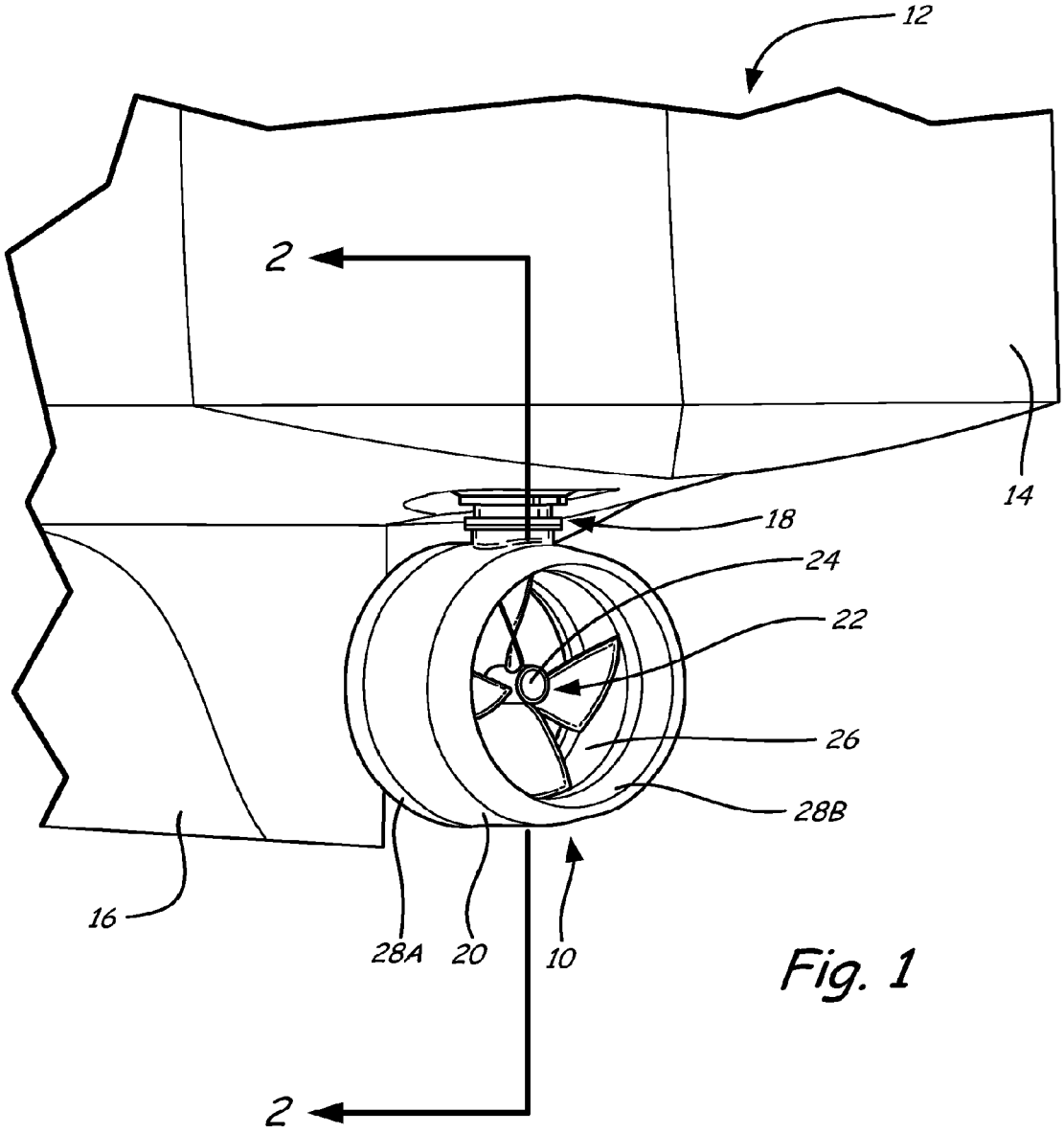
FIG. 1 is a perspective view of a rim driven thruster (RDT) connected to a hull of a waterborne vessel.

FIG. 1 is a perspective view of rim driven thruster (RDT) 10 connected to the stern of waterborne vessel 12. Waterborne vessel 12 may comprise any conventional watercraft, such as a floating ship or underwater submarine. In the embodiment shown, vessel 12 comprises a hull of a ship having transom 14 and keel 16. In operation, vessel 12 is positioned such that keel 16 is submerged and transom 14 is partially submerged in water, or any other fluid, so as to fully submerge RDT 10. RDT 10 is mounted to the hull of vessel 12 by pylon 18 underneath transom 14 and aft of keel 16. RDT 10 includes housing 20, propellers 22, hub 24, rim 26 and forward and aft fairings 28A and 28B. RDT 10 may also be referred to as an integrated motor propeller (IMP).

RDT 10 provides propulsive power to vessel 12 by rotation of propellers 22. RDT 10 swivels about pylon 18 behind keel 16 to steer vessel 12. RDT 10 rotates on pylon 18 under an external power source such as provided from within vessel 12. Propellers 22 are rotated by an electro-magnetic motor integrated into rim 26 and housing 20. A stator core is mounted within housing 20 and receives electric power from vessel 12 through pylon 18. Magnetic forces from the stator core are transmitted to a rotor core mounted on rim 26. Rim 26 drives propellers to rotate on hub 24 within housing 20. Forward fairing 28A and aft fairing 28B provide hydrodynamic shields for housing 20, rim 26, the stator core and the rotor core.

RDT 10 provides hydrodynamic advantages to vessel 12 because the electromagnetic motor is moved out of the flow path provided within housing 20. As such, the effect of hub 24 on hydrodynamic drag is minimized and the length of propellers 22 can be increased, thereby improving thrust production. Operating performance of RDT 10 depends on the electromagnetic performance of the motor configuration. For example, large air gaps between the stator and rotor cores are required to provide corrosion protection. It is, however, also desirable to have a large motor diameter relative to the radial thickness of the stator core to provide better electro-magnetic torque transmission, such as by increasing the number of rotor poles. Furthermore, it is desirable to have radially thin stator and rotor cores to reduce the hydraulic drag of RDT 10. RDT 10 of the present invention utilizes a transverse flux permanent magnet motor to achieve a thin stator core that is easy to manufacture and that transmits substantial torque to the stator core over a large gap.

Figure 2:
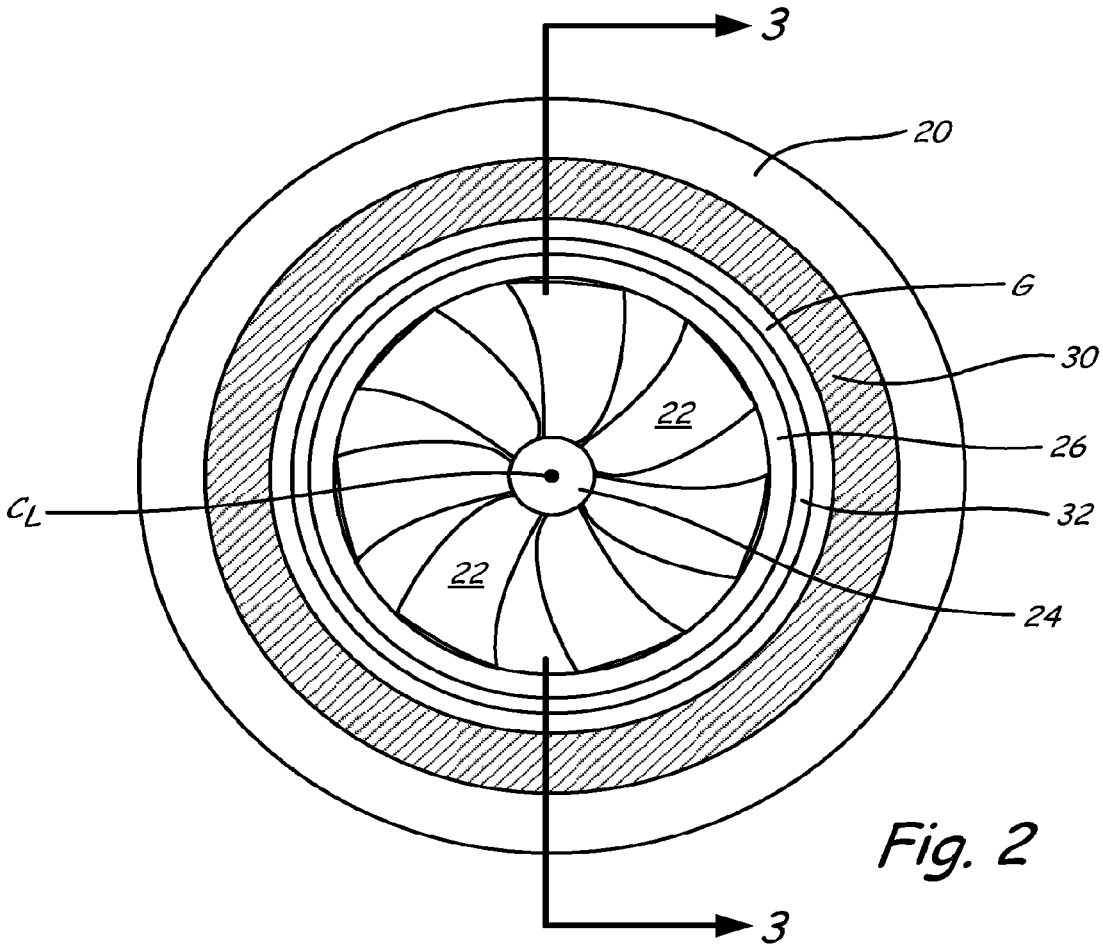
FIG. 2 is an aft view of the rim driven thruster of FIG. 1, as taken at section 2-2, showing a rotor core and a stator core.

FIG. 2 is an aft view of rim driven thruster (RDT) 10 of FIG. 1, as taken at section 2-2, showing stator assembly 30 and rotor assembly 32. FIG. 2 corresponds to a view of RDT 10 with aft fairing 28B removed. RDT 10 also includes housing 20, propellers 22, hub 24 and rim 26. Housing 20 extends axially along centerline CL to form a flow path for water driven by propellers 22. Rim 26 is supported within housing 20 by bearings in various configurations, as discussed with reference to FIGS. 3A and 3B. Hub 24 is supported by propellers 22 within rim 26 so as to be co-axial with centerline CL. Propellers 22 extend radially from hub 24 across the flow path to rim 26. Propellers 22 comprise hydrofoils or blades shaped to accelerate water as they rotate about centerline CL, as is known in the art. Rim 26 comprises a continuous support ring integrally mounted to the tips, or radially outermost portion, of propellers 22. Rotor assembly 32 is affixed to a radially outer surface of rim 26 and comprises an array of permanent magnet pole pairs and a ferromagnetic core. Stator assembly 30 is mounted to a radially inner surface of housing 20 and comprises an array of ferromagnetic cores and a coil winding. Forward fairing 28A and aft fairing 28B (FIG. 1) are connected to forward and aft ends of housing 20, respectively, to cover housing 20, stator assembly 30, rotor assembly 32 and rim 26.

Stator assembly 30 is mounted so as to be a small distance away from rotor assembly 32 to provide gap G. The thicknesses of gap G, as well as rim 26, rotor assembly 32, stator assembly 30 and housing 20 are not drawn to proportion in FIG. 2. In particular, it is desirable to minimize gap G to improve electro-magnetic performance. However, gap G must be provided to permit encapsulation of stator assembly 30 and rotor assembly 32 for corrosion resistance and waterproofing. Stator assembly 30 and rotor assembly 32 of the present invention are configured as a brushless, permanent magnet, transverse flux motor, as described in greater detail with reference to FIGS. 3A-5.

Figure 3A:
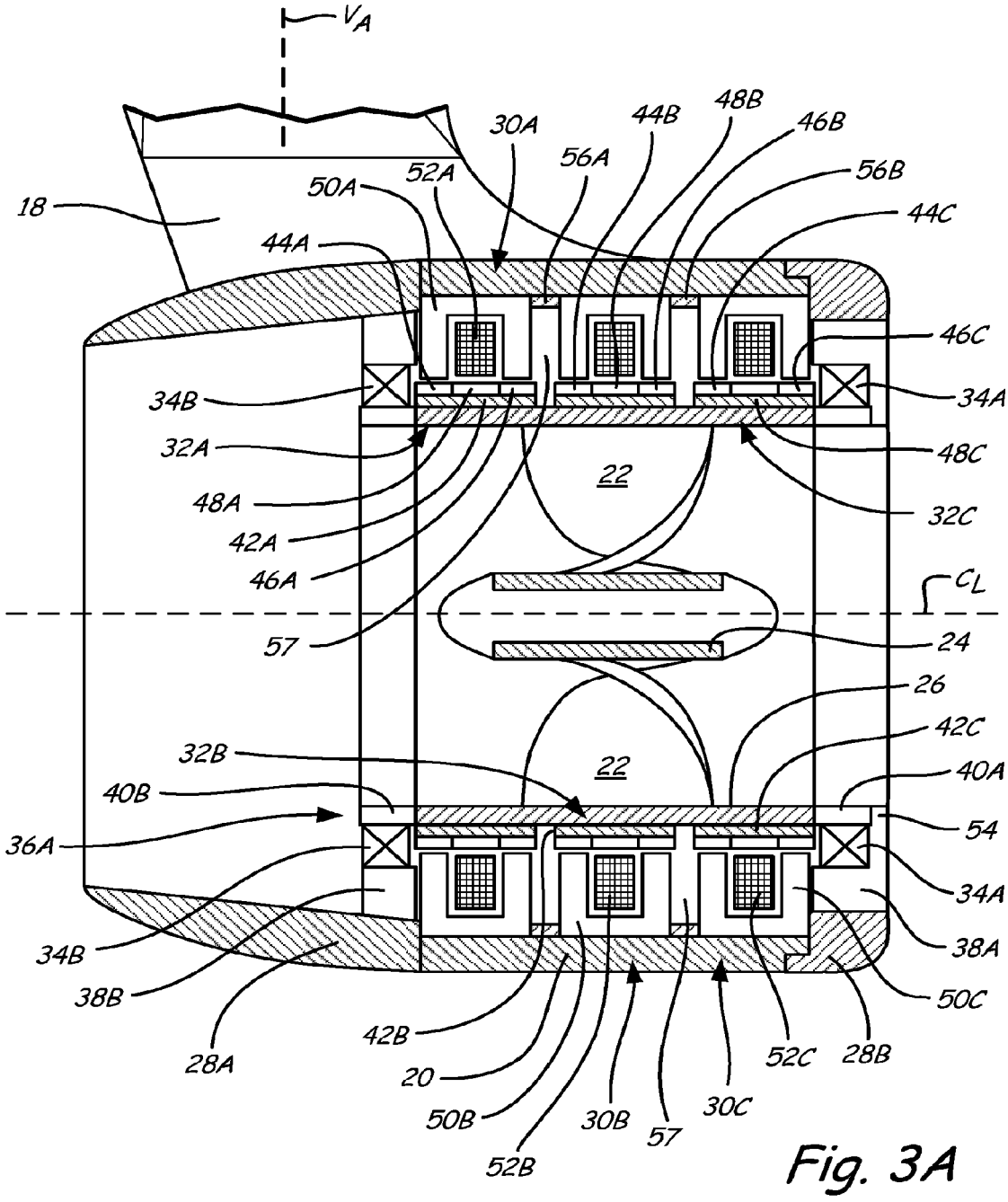
FIG. 3A is a side cross-sectional view of the rim driven thruster of FIG. 2, as taken at section 3-3, showing a propulsor assembly supported by rim bearings.

FIG. 3A is a side cross-sectional view of rim driven thruster 10 of FIG. 2, as taken at section 3-3, showing bearings assemblies 34A and 34B supporting propulsor assembly 36A at rim 26. RDT 10 includes pylon 18; housing 20; forward fairing 28A; aft fairing 28B; stator assemblies 30A, 30B and 30C; rotor assemblies 32A, 32B and 32C; and propulsor assembly 36A. Propulsor assembly 36A comprises propellers 22; hub 24; rim 26; bearing assemblies 34A and 34B; bearing pads 38A and 38B; and bearing rims 40A and 40B. Rotor assemblies 32A, 32B and 32C comprise rotor cores 42A, 42B and 42C; permanent magnets 44A, 44B and 44C; permanent magnets 46A, 46B and 46C; and spacers 48A, 48B and 48C, respectively. Stator assemblies 30A, 30B and 30C comprise stator cores 50A, 50B and 50C; and coil windings 52A, 52B and 52C, respectively.

Annular housing 20 is connected to vessel 12 (FIG. 1) by pylon 18. Pylon 18 rotates about vertical axis VA, which causes RDT 10 to adjust the yaw of vessel 12 when propellers 22 are rotating. Annular housing 20 defines a cylindrical flow path through which center line CL axially extends. Propellers 22 extend radially with respect to center line CL between hub 24 and rim 26. The center of hub 24 extends co-axially along center line CL such that rim 26 of propulsor assembly 36A is supported concentrically within housing 20 by bearing assemblies 34A and 34B when mounted on bearing pads 38A and 38B, respectively.

Figure 3B:
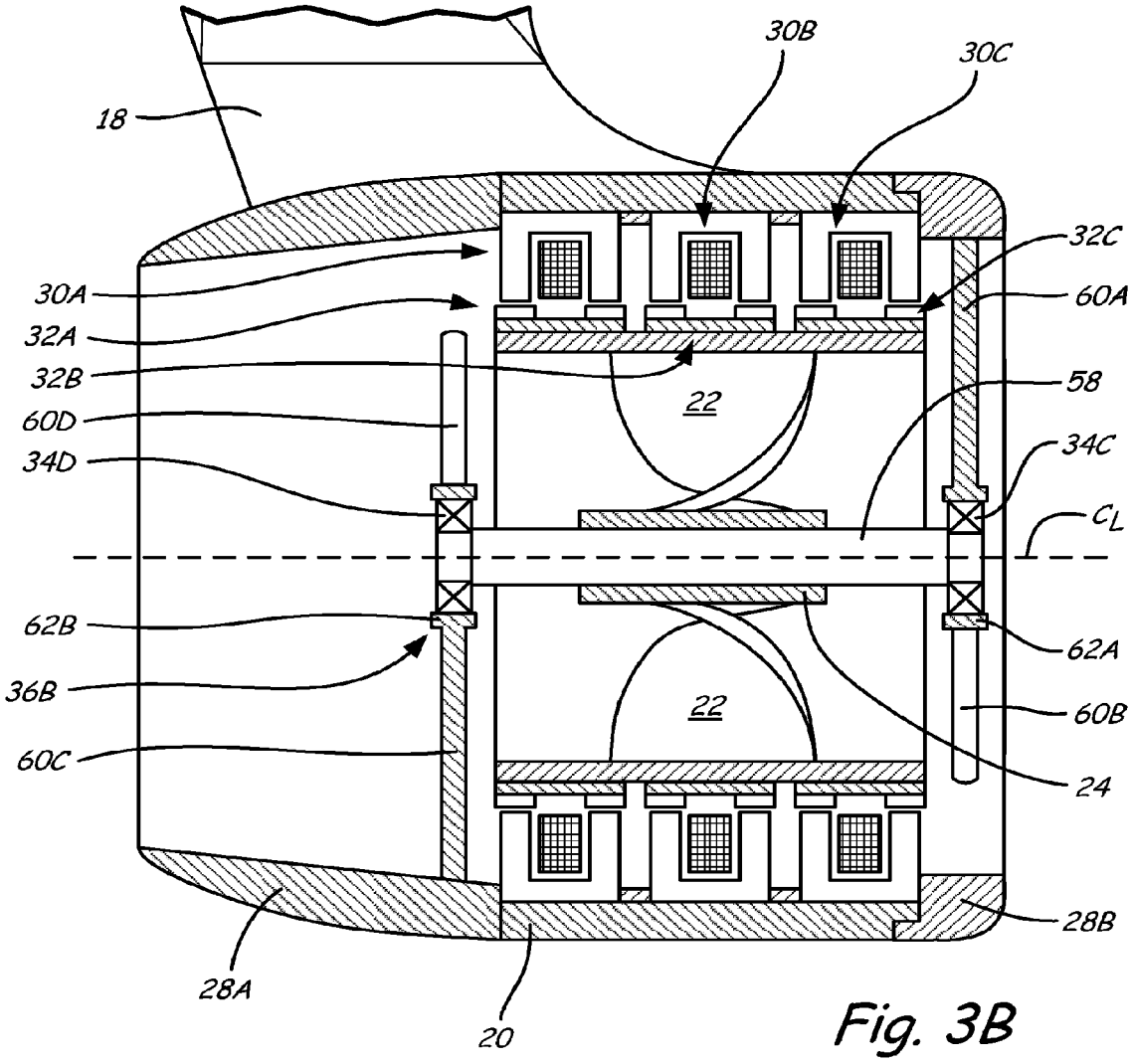
FIG. 3B is an alternate side cross-sectional view of the rim driven thruster of FIG. 2, as taken at section 3-3, showing the propulsor assembly supported by shaft bearings.

Forward fairing 28A and aft fairing 28B are connected to housing 20 to provide hydrodynamic surfaces to RDT 10. Forward fairing 28A is connected to housing 20 at a forward end using any suitable attachment means, such as fasteners. Alternatively, forward fairing 28A may be integrated with housing 20. Forward fairing 28A is shaped to smoothly direct flow of water over RDT 10, while allowing water to enter housing 20 to engage propulsor assembly 36A. Forward fairing 28A includes bearing pad 38B located at an aft end so as to be positioned near rim 26. Aft fairing 28A is connected to housing 20 at an aft end using any suitable attachment means, such as fasteners. Aft fairing 28A is removable from housing 20 to provide access to stator assemblies 30A-30C and rotor assemblies 32A-32C. Although, in other embodiments, aft fairing 28A may be integrated with housing 20 if access is provided elsewhere. Aft fairing 28B includes bearing pad 38A located at a forward end so as to be positioned near rim 26. Aft fairing 28B also includes shield 54, which extends radially inward past bearing assembly 34A and alongside bearing rim 40A. Shield 54 protects bearing assembly 34A and provides a hydrodynamic surface. In other embodiments, shield 54 may be omitted from aft fairing 28B, as shown in FIG. 3B (which will be discussed later), to allow water to directly enter bearing assemblies 34A and 34B, stator assemblies 30A-30C and rotor assemblies 32A-32C for cooling purposes.

Rim 26 is supported by bearing assemblies 34A and 34B at bearing rims 40A and 40B. Bearing rims 40A and 40B comprise forward and aft axial extensions, respectively, of rim 26. Bearing rims 40A and 40B may be integral with rim 26 or separate components fastened to rim 26. Bearing rims 40A and 40B increase the available surface of rim 26 not used to support rotor assemblies 32A-32C. Bearing rims 40A and 40B extend axially beyond stator assemblies 30C and 30A, respectively, such that a radially outer surface faces towards forward fairing 28A and aft fairing 28B, respectively. Bearing rims 40A and 40B thus comprise annular rings against which bearing assemblies 34A and 34B engage.

Forward fairing 28A includes bearing pad 38B, and aft fairing 28B includes bearing pad 38A. Bearing pad 38B is integrally formed with forward fairing 28A, and bearing pad 38A is integrally formed with aft fairing 28B. In other embodiments, bearing pads 38A and 38B may comprise separate components or may be formed as part of housing 20. In any embodiment, bearing pads 38A and 38B comprise annular surfaces or lands against which bearing assemblies 34A and 34B engage. Thus, bearing assemblies 34A and 34B are positioned concentrically between rims 40A and 40B and pads 38A and 38B to permit propulsor assembly 36A to rotate within housing 20 when rotor assemblies 32A-32C are activated by stator assemblies 30A-30C. Specifically, stator assemblies 30A-30C apply an electro-magnetic force to rotor assemblies 32A-32C, respectively, to produce rotational movement of propellers 22 about center line CL.

Stator assemblies 30A-30C are mounted to a radially inward facing surface of housing 20. Specifically, stator cores 50A-50C are joined to housing 20 by any suitable means. Stator cores 50A-50C comprise ferromagnetic material that is fashioned in the form of U-shaped bodies that open toward rim 26. Stator cores 50A-50C each comprise a plurality of U-shaped bodies spaced around centerline CL in a ring-like configuration, as is shown more clearly in FIG. 4. In the axial direction, stator cores 50A-50C are spaced equally along housing 20 with spacers 56A and 56B fitted between. Spacers 56A and 56B comprise rings of non-conducting and non-magnetic material that maintain spaces 57. Coil windings 52A-52C are disposed within the U-shaped bodies formed by stator cores 50A-50C, respectively. Coil windings 52A-52C comprise single toroidal coils that form continuous rings of conducting material.

Rotor assemblies 32A-32C are mounted to a radially outward facing surface of rim 26. Specifically, rotor cores 42A-

Figure 4:
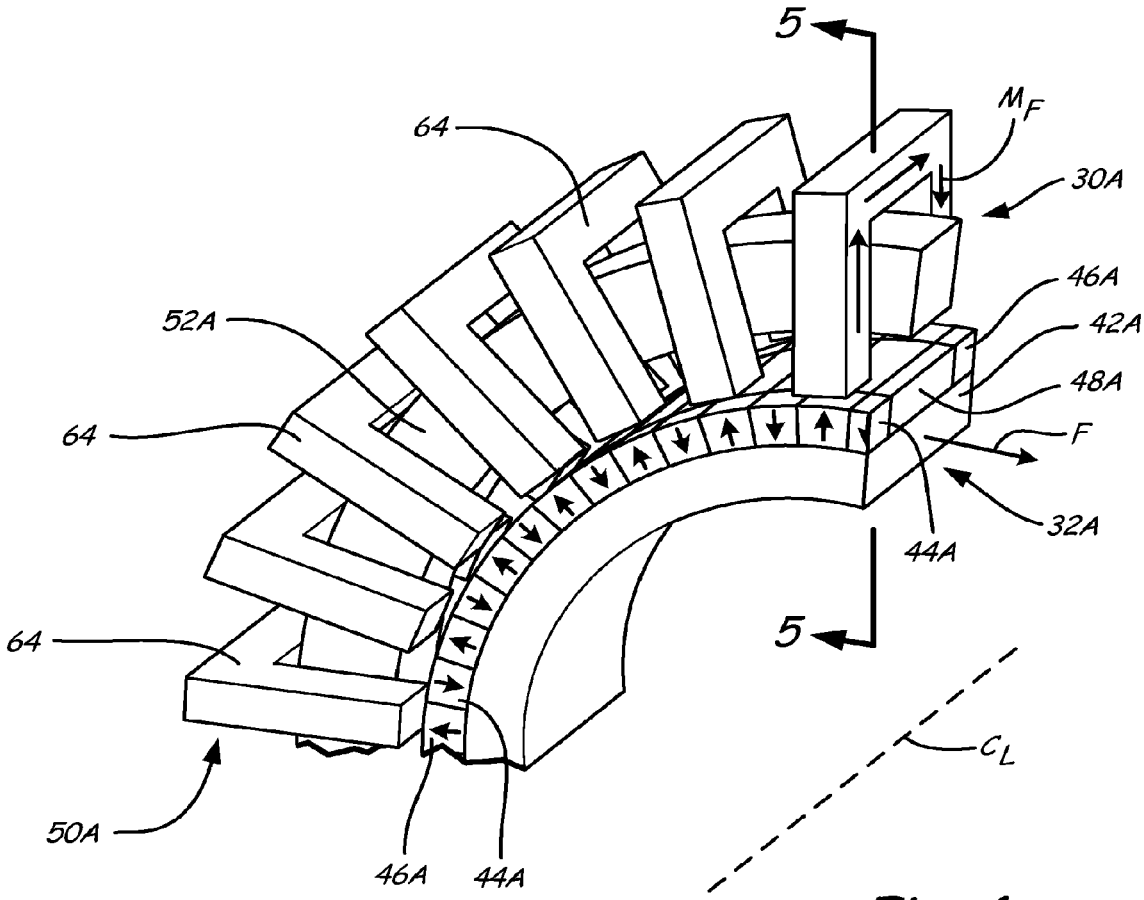
FIG. 4 is a partial perspective view of the rotor assembly and the stator assembly of FIGS. 1-3B.

42C are joined to rim 26 by any suitable means. Rotor cores 42A-42C comprise ferromagnetic material that is fashioned in the form of annular rings that circumscribe rim 26. Rotor cores 42A-42C are spaced equally along rim 26 to align with stator cores 50A-50C. Permanent magnets 44A-44C, permanent magnets 46A-46C and spacers 48A-48C are mounted to radially outward faces of rotor cores 42A-42C, respectively, in a surface-mount configuration. In other embodiments, permanent magnets 44A-44C, 46A-46C and spacers 48A-48C may be mounted in a buried configuration. In yet another embodiment, rim 26 is omitted from propulsor assembly 36A and rotor cores 42A-42C are mounted directly to tips of propellers 22. As shown in the cross-section of FIG. 3A, permanent magnets 44A-44C are mounted to axially forward ends of rotor cores 42A-42C, and permanent magnets 46A-46C are mounted to axially aft ends of rotor cores 42A-42C. However, as shown in FIG. 4, permanent magnets 44A-44C and permanent magnets 46A-46C have opposite magnetic pole orientations and alternate being positioned at forward and aft ends of their respective rotor cores 42A-42C. Spacers 48A-48C comprise non-magnetic material and are disposed on rotor cores 42A-42C between permanent magnets 44A-44C and permanent magnets 46A-46C, respectively, to magnetically isolate rotor cores 32A-32C from each other.

Rotor assemblies 32A-32C and stator assemblies 30A-30C are easily mounted in configurations advantageous to operation of RDT 10. For example, the axial length of stator assemblies 30A-30C is shortened in transverse flux motors as compared to conventional magneto-electric motors having parallel flux lines. The shortened size of stator assemblies 30A-30C permit easy integration of spacers 56A and 56B, which spread stator assemblies 30A-30C along housing 20 to produce spaces 57. Spaces 57 permit water, or other fluid in which RDT 10 is submerged, to cool stator assemblies 30A-30C. Also, rotor assemblies 32A-32C are maintained at a gap-distance from stator assemblies 32A-32C, respectively. The gap-distance is suitable to permit propulsor assembly 36A to rotate and to permit incorporation of corrosion protection coatings on stator assemblies 30A-30C and rotor assemblies 32A-32C. For example, rotor assemblies 32A-32C and stator assemblies 30A-30C may be encapsulated in an epoxy or some other material that is non-insulating and water resistant. In other embodiments, rotor assemblies 32A-32C and stator assemblies 30A-30C may be incorporated into structural members. For example, stator assemblies 30A-30C may be positioned within housing 20 to provide environmental protection. The gap-distance between rotor assemblies 32A-32C and stator assemblies 30A-30C is maintained as small as possible to accommodate encapsulation while also permitting rotor cores 32A-32C to maintain efficient electromagnetic interaction with stator cores 30A-30C.

Arranged as such within RDT 10, stator assemblies 30A-30C and rotor assemblies 32A-32C form a three-phase, single-sided magneto-electric motor. In a three-phase motor, alternating current is applied to stator cores 52A-52C one-hundred-twenty degrees out of phase, as is known in the art. In other embodiments, other multi-phase configurations can be used, rather than three-phase. In a single-sided motor, current from a single stator core is applied to each rotor core. In other embodiments, double-sided motors can be used wherein current from a pair of stator cores is applied to each rotor core, one from the outside and one from the inside. Alternating electrical current is supplied directly to coil windings 52A-52C such as from a power source in vessel 12 (FIG. 1). A conventional solid-state, three-phase inverter may be used. Current within coil windings 52A-52C causes magnetic flux to flow through stator cores 50A-50C. The oppositely oriented magnetic poles of permanent magnets 44A-44C and permanent magnets 46A-46C cause magnetic flux to travel through rotor assemblies 32A-32C. Spacers 56A and 56B isolate magnetic flux in each pair of permanent magnets 44A-44C and 46A-46C, respectively, causing the flux path within rotor cores 32A-32C to travel through rotor cores 42A-42C. The magnetic flux of stator cores 30A-30C interacts with the magnetic flux of permanent magnets 44A-44C and permanent magnets 46A-46C to apply a torque to rim 26. Bearing assemblies 34A and 34B permit rim 26 and rotor assembly 36A to rotate smoothly about center line CL.

FIG. 3B is an alternate side cross-sectional view of rim driven thruster 10 of FIG. 2, as taken at section 3-3, showing bearing assemblies 34C and 34D supporting propulsor assembly 36B at shaft 58. RDT 10 includes stator assemblies 30A-30C and rotor assemblies 32A-32C, which comprise the same structures as described with reference to FIG. 3A. As such, discussion of stator assemblies 30A-30C and rotor assemblies 32A-32C is omitted with reference to FIG. 3B for brevity. RDT 10 also includes pylon 18, housing 20, propellers 22, hub 24, rim 26, forward fairing 28A and aft fairing 28B, as was discussed with reference to propulsor assembly 36A of FIG. 3A. Propulsor assembly 36B includes support brackets 60A, 60B, 60C and 60D. Support brackets 60A and 60B extend radially inward from aft fairing 28B straight towards support ring 62A. Support brackets 60A and 60B comprise two of three support brackets (the third not seen in the cross-section of FIG. 3B) spaced one-hundred-twenty degrees apart within aft fairing 28B. Support brackets 60C and 60D extend radially inward from forward fairing 28A straight towards support ring 62B. Support brackets 60C and 60D comprise two of three support brackets (the third not seen in the cross-section of FIG. 3B) spaced one-hundred-twenty degrees apart within forward fairing 28A. In other embodiments, support brackets 60A-60D extend directly from housing 20, rather than fairings 28A and 28B. Support brackets 60A-60D provide structure for supporting shaft 58 with support rings 62A and 62B. Bearing assemblies 34C and 34D are fitted within support rings 62A and 62B, respectively. Bearing assemblies 34C and 34D receive opposite ends of shaft 58. Shaft 58 extends from bearing assembly 34C, through hub 24 and into bearing assembly 34D. Hub 24 is fitted around shaft 58, such as with a force fit, so that hub 24 and shaft 58 rotate in unison. As such, propellers 22 are permitted to rotate about centerline CL as shaft 58 rotates in bearing assemblies 34C and 34D when torque is applied to rotor assemblies 32A-32C by stator assemblies 30A-30C.

FIG. 4 is a partial perspective view of stator assembly 30A and rotor assembly 32A of FIGS. 1-3B. Stator assembly 30A includes stator core 50A and coil winding 52A. Stator core 50A includes U-shaped cores 64. In the embodiment shown, stator core 50A is comprised of twenty-eight U-shaped cores 64, as FIG. 4 shows a quarter section of stator assembly 30A. Rotor assembly 30A includes rotor core 42A, spacer 48A and a plurality of permanent magnets 44A and 46A. As shown in FIG. 4, permanent magnets 44A are configured to have magnetic pole orientations that extend radially outward, and permanent magnets 46A are configured to have magnetic pole orientations that extend radially inward. Permanent magnets 44A and permanent magnets 46A are disposed along forward and aft surfaces of spacer 48A in an alternating fashion such that a permanent magnet 44A at the forward surface is axially aligned with a permanent magnet 46A at the aft surface.

When operating as an electric motor, stator core 30A and rotor core 32A interact magnetically to cause rotation of rotor assembly 30A about centerline CL. Alternating electric current is applied to coil winding 52A, which causes magnetic flux MF to flow through U-shaped cores 64. Magnetic flux MF reverses direction as the applied current alternates. Magnetic flux MF travels through the plane formed by each U-shaped core 64, and the electric current travels perpendicular to this plane in coil winding 52A. Magnetic flux MF induced in U-shaped cores 64 interact with the pole orientations of permanent magnets 44A and 46A, generating force vector F. Force vector F is aligned in a direction that is tangential to rotor assembly 32A. Specifically, force vector F is perpendicular to the plane of magnetic flux MF, which causes torque to be applied to rotor core 42A and the rest of propulsor assembly 36A or 36B.

Performance of RDT 10 benefits from the construction of stator assembly 30A and rotor assembly 32A. Stator assembly 30A only requires a single coil provided by coil winding 52A. Also, the size of stator assembly 30A can be increased in the axial direction, such that the height can be decreased. These configurations permit stator assembly 30A to be radially thin. The diameter of RDT 10 is increased by the thin construction of stator assembly 30A, which allows the diameter of rotor core 42A to be increased to include a greater number of permanent magnets 44A and 46A. The increased number of magnetic poles present from permanent magnets 44A and 46B allows for better torque transmission, among other things.

FIG. 5 is a side cross-sectional view of a second embodiment of stator assembly 30A of FIG. 4, as taken at section 5-5, showing stator core 50A comprising U-shaped core 64 formed by laminations 66A, laminations 66B and yoke 68. Coil winding 52A extends through U-shaped cored 64 between laminations 66A and 66B. Yoke 68 is attached to an interior surface of housing 20 (FIG. 2) such that U-shaped core 64 opens towards rotor assembly 32A (FIG. 4). Yoke 68 extends axially from a first end, where laminations 66A are attached, to a second end, where laminations 66B are attached. Laminations 66A and 66B extend radially from yoke 68. Laminations 66A together form arm 70A, and laminations 66B together form arm 70B. Yoke 68, laminations 66A and laminations 66B form a U-shaped channel that forms a magnetic path. The U-shaped channel forms a planar magnetic circuit through which magnetic flux flows when current is applied to coil winding 52A. Arm 70A, arm 70B and yoke 68 are assembled together in any suitable fashion. Encapsulation layer 72 surrounds exposed surfaces of stator core 50A to protect arm 70A, arm 70B and yoke 68 from corrosion and the operating environment of RDT 10.

Laminations 66A and 66B extend radially from yoke 68 so that they are parallel to magnetic flux MF (FIG. 4) within U-shaped core 64, which preserves the transverse flux nature of stator assembly 30A. Laminations 66A and 66B and yoke 68 are comprised of ferromagnetic material, such as cobalt alloy, silicon steel, nickel, iron or other similar materials. Laminations 66A and 66B comprise thin plates of solid ferromagnetic material that can be easily stamped or cut from stock materials to facilitate easy manufacturing. Yoke 68 is comprised of a solid piece of material machined to the appropriate shape. Yoke 68 may also be formed of laminations extending in the axial direction (between first arm 70A and second arm 70B) that are stacked in the tangential direction (in the plane of the paper of FIG. 5) to avoid laminations extending perpendicular to magnetic flux MF in yoke 68. Yoke 68 may also be comprised of a sintered powder. Likewise, arms 70A and 70B may be comprised of a sintered powder in embodiments not using laminations. U-shaped cores suitable for use in the present invention are described in greater detail in U.S. Patent Application No. 2010/0052467 A1 to Gieras and assigned to Hamilton Sundstrand Corporation, Rockford, Ill., which is incorporated herein by reference.

Figure 5A:
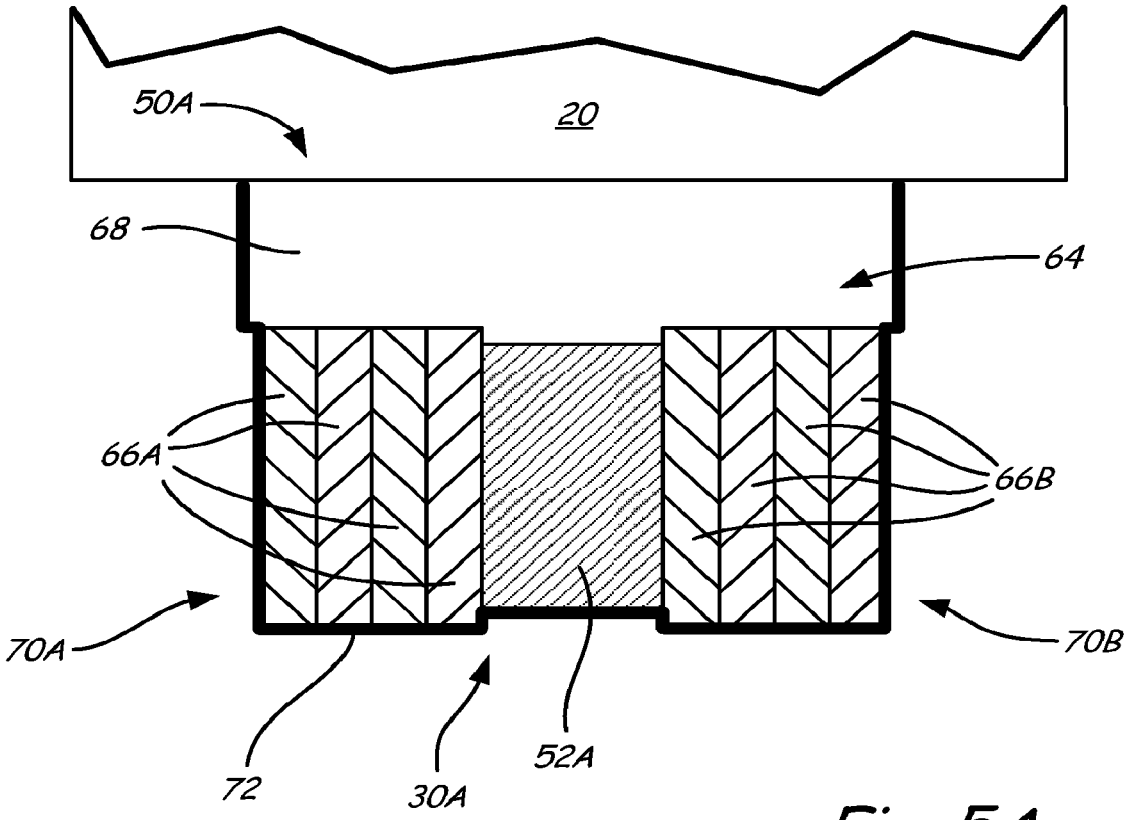
FIG. 5A is a side cross-sectional view of a first embodiment of the stator assembly of FIG. 4, as taken at section 5-5, showing a stator core comprising a U-shaped core formed by laminations and a yoke.
Figure 5B:
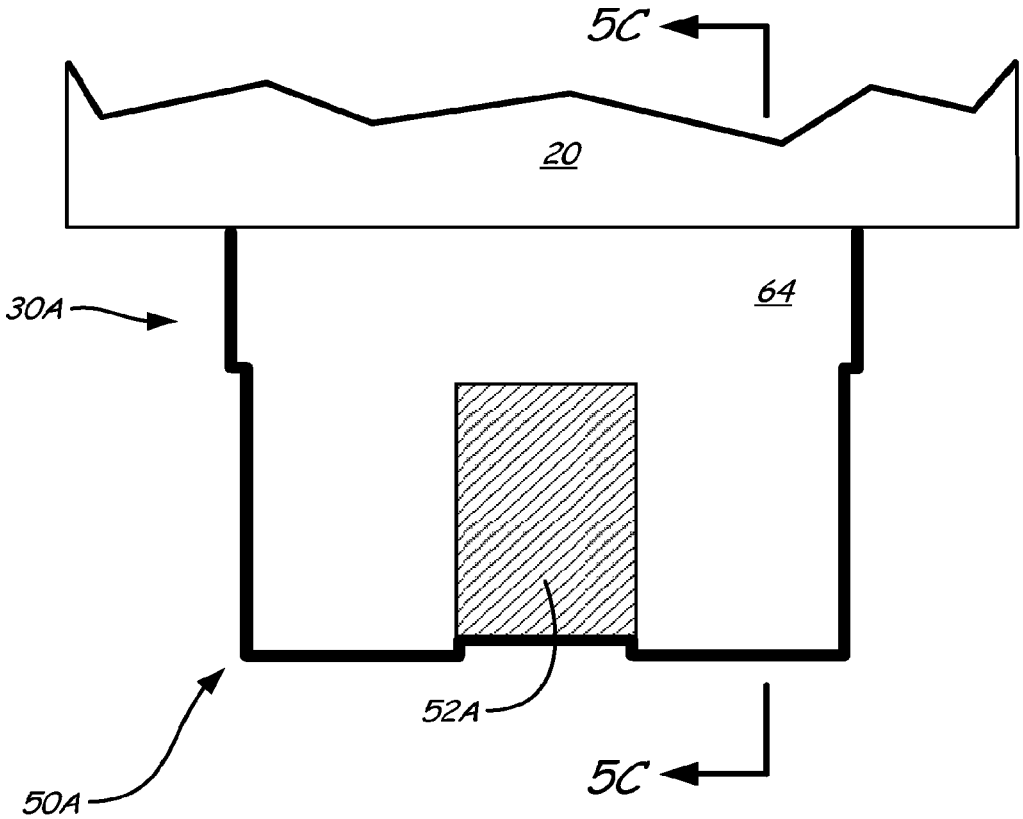
FIG. 5B is a side cross-sectional view of a second embodiment of the stator assembly of FIG. 4, as taken at section 5-5, showing a stator core comprising a U-shaped core.
Figure 5C:
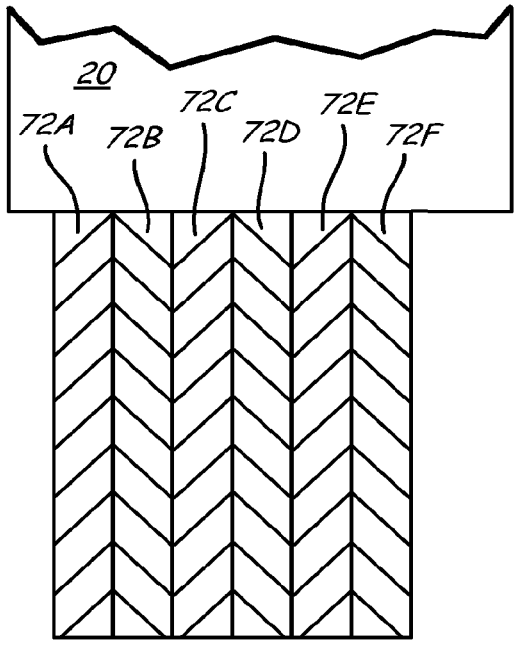
FIG. 5C is a cross-sectional view of FIG. 5B as taken as section 5B-5B, showing lamination layers of the U-shaped core.

FIG. 5B is a side cross-sectional view of a second embodiment of stator assembly 30A of FIG. 4, as taken at section 5-5, showing stator core 50A comprising U-shaped core 64. FIG. 5C, which is discussed concurrently with FIG. 5B, is a cross-sectional view of FIG. 5B as taken as section 5B-5B, showing lamination layers 72A-72F of U-shaped core 64. Stator assembly 30A also includes coil winding 52A as discussed with reference to FIG. 5A. Laminations 72A-72F comprise U-shaped laminations mounted to housing 20. Laminations 72A-72F each include a pair of longitudinally extending portions that connect a transversely extending portion. The longitudinal and transverse portions are stacked in the tangential direction (in the plane of the paper of FIG. 5B) to form a magnetic flux path similar to that of arms 70A, 70B and yoke 68 of FIG. 5A. As with the previously described embodiment, laminations 72A-72F are comprised of easily formed pieces of ferromagnetic material, such as cobalt alloy, silicon steel, nickel, iron or other similar materials.

Transverse flux motors provide advantages to rim driven thrusters and integrated motor propellers. Specifically, transverse flux motors provide built-in step down of electromagnetic transmission, such that high frequency input current, such as may be provided from a gas turbine engine, is transformed into low shaft speed. Higher frequency input current allows for smaller motors having higher power density. Higher power density is further achieved by increased numbers of permanent magnet poles enabled by transverse flux machines. Transverse flux machines also permit increased size of gap G (FIG. 2), which allows for better sealing and encapsulation of the stator and rotor assemblies. Construction of the transverse flux machines described is simple, comprising only a single stator winding and simple rotor core laminations. Additionally, each stator and rotor assembly in multiphase configurations are identical, reducing the number of components and associated manufacturing costs. Rim driven thrusters using transverse flux machines can provide power output in the range of kilowatts up to megawatts.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A rim driven thruster comprising:

an annular housing defining a flow path extending along an axis;

a propulsor assembly supported within the annular housing, the propulsor assembly comprising propeller blades extending radially from the axis of the flow path and configured to rotate about the axis;

a first magnetic rotor assembly mounted to radially outer ends of the propeller blades; and a first transverse flux stator assembly mounted to the annular housing and configured to provide electromagnetic torque to the first magnetic rotor assembly.

2. The rim driven thruster of claim 1 wherein:

the first transverse flux stator assembly includes a core assembly having a magnetic path such that magnetic flux travels from the first magnetic rotor assembly to the first transverse flux stator assembly and from the first transverse flux stator assembly to the first magnetic rotor assembly in a plane extending radially from and along the axis; and an electromagnetic force vector from the first transverse flux assembly acts on the first magnetic rotor assembly in a direction perpendicular to the plane.

3. The rim driven thruster of claim 2 wherein the core assembly comprises:

a plurality of U-shaped ferromagnetic cores forming a channel opening radially inwardly to the first magnetic rotor assembly; and a single coil winding extending through the channel and circumscribing the first magnetic rotor assembly.

4. The rim driven thruster of claim 3 wherein each of the U-shaped ferromagnetic cores comprises:

an elongate yoke connected to the annular housing and extending in a direction of the axis from a first end to a second end;

a first arm extending radially inwardly from the first end; and a second arm extending radially inwardly from the second end.

5. The rim driven thruster of claim 4 wherein the yoke, the first arm and the second arm comprise an assembly of separate components joined to form a magnetic circuit through the U-shaped ferromagnetic core.

6. The rim driven thruster of claim 4 wherein the yoke, the first arm and the second arm are comprised of sintered powder ferromagnetic material.

7. The rim driven thruster of claim 4 wherein the yoke, the first arm and the second arm are comprised of ferromagnetic laminations.

8. The rim driven thruster of claim 4 wherein the first magnetic rotor assembly comprises:

an annular ferromagnetic core connected to the propeller blades; and a plurality of magnetic rotor pole pairs mounted to an outer diameter surface of the annular ferromagnetic core to face the single coil winding.

9. The rim driven thruster of claim 8 wherein each of the plurality of magnetic rotor pole pairs comprise:

a first permanent magnet connected to the annular ferromagnetic core opposite a first arm of a U-shaped ferromagnetic core and having a magnetic pole orientation extending radially outward;

a second permanent magnet connected to the annular ferromagnetic core opposite a second arm of a U-shaped ferromagnetic core and having a magnetic pole orientation extending radially inward; and a spacer positioned between the first permanent magnet and the second permanent magnet.

10. The rim driven thruster of claim 1 wherein the propulsor assembly further comprises:

a hub from which the propeller blades extend;

a support rim surrounding the propulsor blades within the annular housing; and bearings supporting the propulsor assembly between the support rim and the annular housing.

11. The rim driven thruster of claim 1 wherein the propulsor assembly further comprises:

a hub from which the propeller blades extend;

a shaft extending through the hub;

support brackets extending from the annular housing toward the shaft to support the propulsor assembly; and bearings positioned between the shaft and the support brackets.

12. The rim driven thruster of claim 1 and further comprising:

second and third magnetic rotor assemblies mounted to the radially outer ends of the propeller blades; and second and third transverse flux stator assemblies mounted to the annular housing;

wherein the first, second and third magnetic rotor assemblies align with the first, second and third transverse flux stator assemblies, respectively, to form three pairs of cores configured as a three-phase electro-magnetic motor.

13. The rim driven thruster of claim 12 and further comprising spacers positioned between the pairs of cores to form slots.

14. The rim driven thruster of claim 1 and further comprising first and second corrosion protection coatings overlying the first magnetic rotor assembly and the first transverse flux stator assembly, respectively.

15. A rim driven thruster comprising:

an annular housing defining an axial flow path;

a propulsor assembly comprising:

a hub mounted co-axially within the annular housing; and a plurality of propeller blades extending radially out from the hub;

a rotor assembly comprising:

an annular rotor core connected to the plurality of propeller blades; and a plurality of permanent magnets disposed about the annular rotor core; and a stator assembly comprising:

a plurality of ferromagnetic cores mounted to the annular housing, the plurality of permanent magnets having radially extending magnetic flux paths; and a single coil winding extending through the plurality of ferromagnetic cores perpendicular to the magnetic flux paths in a tangential direction.

16. The rim driven thruster of claim 15 wherein each of the ferromagnetic cores comprises:

an elongate yoke connected to the annular housing and extending axially from a first end to a second end;

a first arm extending radially inwardly from the first end; and a second arm extending radially inwardly from the second end;

wherein the elongate yoke, the first arm and the second arm form a U-shaped channel opening radially inwardly to the first magnetic rotor assembly and the magnetic flux paths travel in a radially extending plane formed by the first arm, second arm and yoke.

17. The rim driven thruster of claim 16 wherein each of the plurality of permanent magnets comprise:

a first permanent magnet connected to the annular rotor core opposite a first arm of a ferromagnetic core and having a magnetic pole orientation extending radially outward;

a second permanent magnet connected to the annular rotor core opposite a second arm of a ferromagnetic core and having a magnetic pole orientation extending radially inward; and a spacer positioned between the first permanent magnet and the second permanent magnet.

18. The rim driven thruster of claim 16 wherein the yoke, the first arm and the second arm are comprised of sintered powder ferromagnetic material.

19. The rim driven thruster of claim 16 wherein the yoke, the first arm and the second arm are comprised of ferromagnetic laminations.

20. The rim driven thruster of claim 15 wherein the propulsor assembly further comprises:

a support rim surrounding the propulsor blades within the annular housing; and bearings supporting the propulsor assembly between the support rim and the annular housing.

21. The rim driven thruster of claim 15 wherein the propulsor assembly further comprises:

a shaft extending through the hub;

support brackets extending from the annular housing toward the shaft to support the propulsor assembly; and bearings positioned between the shaft and the support brackets.

* * * * *